US011110706B2

(12) United States Patent
Hashimoto et al.

(10) Patent No.: US 11,110,706 B2
(45) Date of Patent: Sep. 7, 2021

(54) LIQUID EJECTING HEAD AND METHOD OF MANUFACTURING LIQUID EJECTING HEAD

(71) Applicant: CANON KABUSHIKI KAISHA, Tokyo (JP)

(72) Inventors: Yusuke Hashimoto, Yokohama (JP); Takanobu Manabe, Oita (JP); Kenji Fujii, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/560,433

(22) Filed: Sep. 4, 2019

(65) Prior Publication Data

US 2020/0079083 A1 Mar. 12, 2020

(30) Foreign Application Priority Data

Sep. 7, 2018 (JP) ..... JP2018-168178

(51) Int. Cl.
*B41J 2/14* (2006.01)
*B41J 2/16* (2006.01)

(52) U.S. Cl.
CPC ..... *B41J 2/14145* (2013.01); *B41J 2/1433* (2013.01); *B41J 2/14* (2013.01); *B41J 2/16* (2013.01); *B41J 2002/14419* (2013.01)

(58) Field of Classification Search
CPC ..... B41J 2/14145; B41J 2/1433; B41J 2/14; B41J 2002/14419
See application file for complete search history.

(56) References Cited

U.S. PATENT DOCUMENTS

| | | | | |
|---|---|---|---|---|
| 4,680,859 | A * | 7/1987 | Johnson | B41J 2/14024 156/272.2 |
| 6,143,190 | A | 11/2000 | Yagi et al. | |
| 6,560,871 | B1 * | 5/2003 | Ramos | B41J 2/1603 29/890.1 |
| 6,666,546 | B1 | 12/2003 | Buswell et al. | |
| 6,746,106 | B1 | 6/2004 | Hager | |
| 7,901,064 | B2 | 3/2011 | Urayama et al. | |
| 8,047,632 | B2 | 11/2011 | Fujii et al. | |
| 10,147,621 | B2 | 12/2018 | Takada et al. | |
| 10,421,276 | B2 | 9/2019 | Saito et al. | |
| 2003/0025754 | A1 | 2/2003 | Mou et al. | |

(Continued)

FOREIGN PATENT DOCUMENTS

| | | | |
|---|---|---|---|
| CN | 1314244 | A | 9/2001 |
| JP | 10-181032 | A | 7/1998 |

(Continued)

OTHER PUBLICATIONS

U.S. Appl. No. 16/560,467, Satoshi Ibe Takanobu Manabe, filed Sep. 4, 2019

(Continued)

*Primary Examiner* — Geoffrey S Mruk
(74) *Attorney, Agent, or Firm* — Venable LLP

(57) ABSTRACT

A liquid ejecting head having high reliability can be manufactured such that the occurrence of cracks in the print element substrate can be suppressed. The supply port of the print element substrate has an opening, the opening width of which at each end portion in the longitudinal direction is narrower than the opening width at the center portion in the longitudinal direction.

12 Claims, 9 Drawing Sheets

(56) References Cited

U.S. PATENT DOCUMENTS

| | | | |
|---|---|---|---|
| 2018/0147844 | A1 | 5/2018 | Kurokawa |
| 2018/0326723 | A1 | 11/2018 | Manabe et al. |

FOREIGN PATENT DOCUMENTS

| | | | |
|---|---|---|---|
| JP | 2016-097681 | A | 5/2016 |
| JP | 2017-209939 | A | 11/2017 |
| JP | 2018-056159 | A | 4/2018 |

OTHER PUBLICATIONS

Extended European Search Report dated Jan. 21, 2020, in European Patent Application No. 19195277.9.

* cited by examiner

LIQUID EJECTING HEAD AND METHOD OF MANUFACTURING LIQUID EJECTING HEAD

BACKGROUND OF THE INVENTION

Field of the Invention

The present invention relates to a liquid ejecting head including ejection ports that eject liquid supplied from a supply port and a method of manufacturing the liquid ejecting head.

Description of the Related Art

In a substrate used in a liquid ejecting head, formed are ejection ports that eject liquid and a supply port which is a through hole for supplying the ejection ports with the liquid. The portion in which the supply port is formed is a silicon substrate. In recent years, there has been demand for downsizing the substrate to reduce the cost of the apparatus.

Japanese Patent Laid-Open No. H10-181032 discloses a method of manufacturing inkjet print heads which is capable of forming an ink supply port which is a through-hole having specified dimensions, by using a sacrificial layer, which can be selectively etched on the substrate material, to prevent the variation of the opening diameter of the ink supply port.

SUMMARY OF THE INVENTION

A liquid ejecting head according to the present invention comprises a substrate including an ejection port array in which multiple ejection ports each capable of ejecting liquid are arrayed, and a supply port which communicates with the ejection ports and opens to a back surface of the substrate opposed to a front surface of the substrate on which the ejection ports are located. The supply port is arranged along the ejection port array, and the opening width, in a width direction intersecting a row direction of the ejection port array, of at least one end portion in the row direction of the supply port is smaller than the opening width in the width direction of a center portion in the row direction of the supply port.

Further features of the present invention will become apparent from the following description of exemplary embodiments with reference to the attached drawings.

DESCRIPTION OF THE EMBODIMENTS

In a case where the substrate is downsized, the thickness of the walls around the supply port in the silicon substrate is reduced, leading to a low rigidity of the silicon substrate. For example, the silicon substrate is joined to a support member made of resin. The stress caused when the silicon substrate and the support member are joined sometimes causes cracks at corner portions at opening ends of the supply port. In the case where cracks occur, desired ejection may not be performed.

To address this, the present invention provides a liquid ejecting head with high reliability in which the occurrence of cracks in the substrate is prevented and a method of manufacturing the liquid ejecting head.

First Embodiment

Hereinafter, a first embodiment of the present invention will be described with reference to the drawings.

Figure 1:
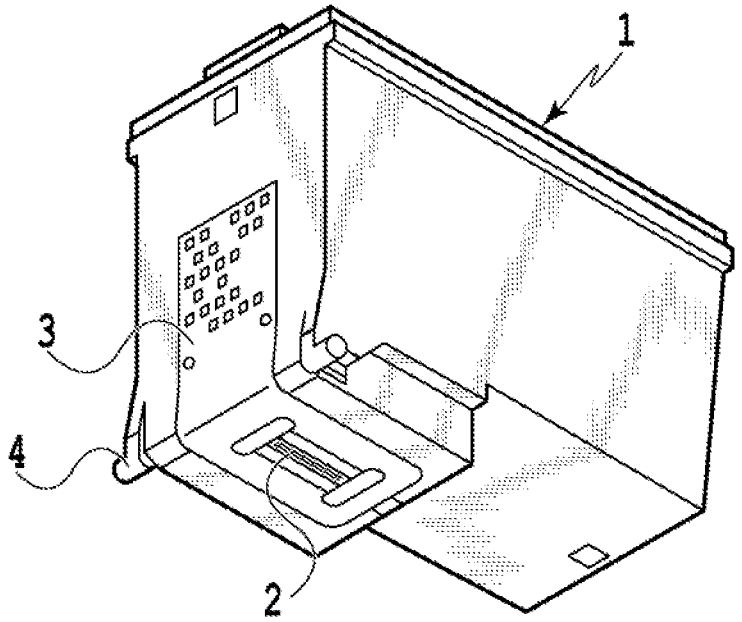
FIG. 1 is a perspective view of a liquid ejecting head.

FIG. 1 is a perspective view of a liquid ejecting head 1 to which the present embodiment is applicable. The liquid ejecting head 1 includes a print element substrate 2, electric wiring board 3, and support member 4. The print element substrate 2 is supported by the support member 4 and connected to the electric wiring board 3.

Figure 2:
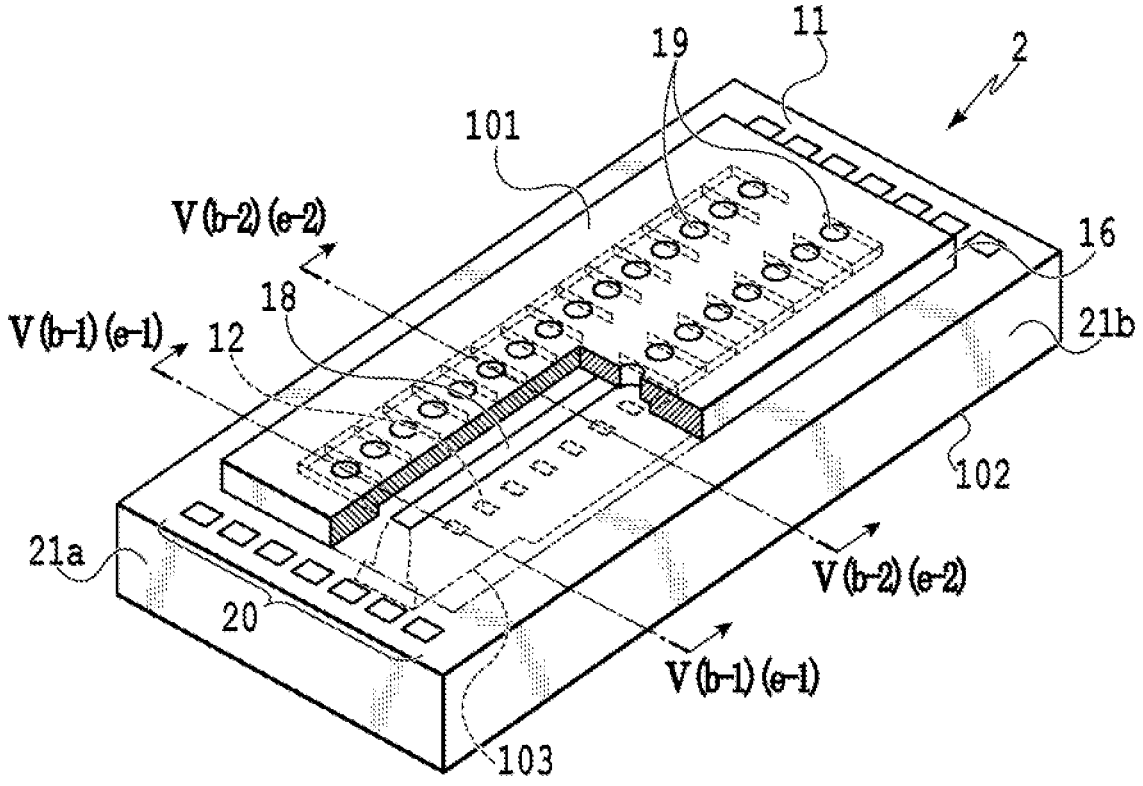
FIG. 2 is a perspective view of a print element substrate.

FIG. 2 is a perspective view of the print element substrate 2. The print element substrate 2 includes a silicon substrate 11 and an ejection port member 16. The ejection port member 16 has multiple ejection ports 19 capable of ejecting liquid and flow paths associated with the respective ejection ports. The ejection ports 19 are arranged in rows. The silicon substrate 11 is formed of silicon, and the silicon substrate 11 has a supply port 18 which is a through-hole that opens to the back surface opposed to the front surface on which the ejection ports 19 of the print element substrate 2 are provided. The supply port 18, formed by etching, communicates with the flow paths of the ejection port member 16. The silicon substrate 11 has energy generating elements 12 formed to be associated with the flow paths of the ejection port member 16. The energy generating elements 12 are located at positions facing the respective ejection ports 19. The energy generating elements 12 are located in rows, and there are two rows respectively on two sides of the supply port 18. The supply port 18 is a through-hole formed by etching the silicon substrate 11 made of single crystal silicon, the plane direction of which is [100].

The print element substrate 2 has an ejection port surface 101, a back surface 102 opposed to the ejection port surface 101, and four side surfaces 21*a* and 21*b* on the sides of the ejection port surface 101. The side surfaces 21*a* are side surfaces on the short sides of the print element substrate 2, and the side surfaces 21*b* are side surface on the long sides of the print element substrate 2. Along at least one side (two sides in the present embodiment) of the joint surface between the silicon substrate 11 and the ejection port member 16, there are formed connection terminals 20, electrically connected to lead terminals 24 (described later), for receiving drive signals and drive power. The drive signals inputted to the connection terminals 20 drive the energy generating elements 12. The liquid ejecting head 1 performs printing by applying the pressure generated by the energy generating elements 12 to ink (liquid) put into the flow paths via the supply port 18, thus ejecting droplets through the ejection ports 19, and making the droplets attach to a print medium.

Figure 3A:
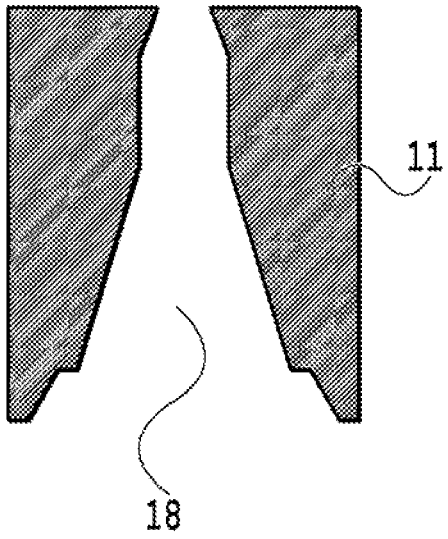
FIG. 3A is a cross-sectional view of the print element substrate.
Figure 3B:
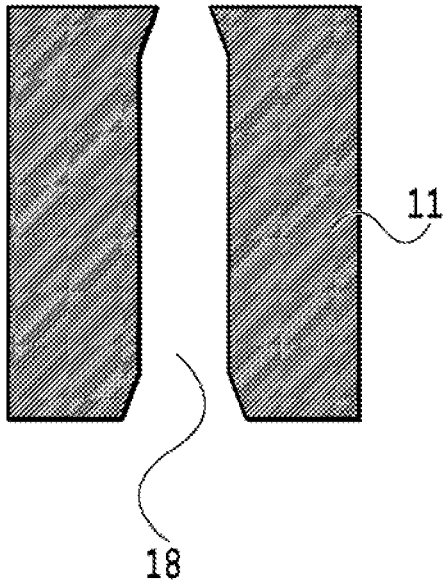
FIG. 3B is a cross-sectional view of the print element substrate.

FIG. 3A is a cross-sectional view of the print element substrate 2 taken along line V(b-2)(e-2)-V(b-2)(e-2) in FIG. 2; FIG. 3B is a cross-sectional view of the print element substrate 2 taken along line V(b-1)(e-1)-V(b-1)(e-1) in FIG. 2. The supply port 18 provided in the print element substrate 2 has a wide opening width (in the width direction which is a direction intersecting the row direction of the ejection port array) at the center portion of the back surface 102 of the print element substrate 2 as illustrated in FIG. 3A and a narrow opening width at both end portions of the supply port 18 as illustrated in FIG. 3B. In other words, on the back surface 102 of the print element substrate 2, the walls at both sides of the supply port 18 are thicker at the end portions than at the center portion. Note that a configuration in which at least one of the end portions of the supply port 18 has a width narrower than the center portion is possible.

Figure 4A:
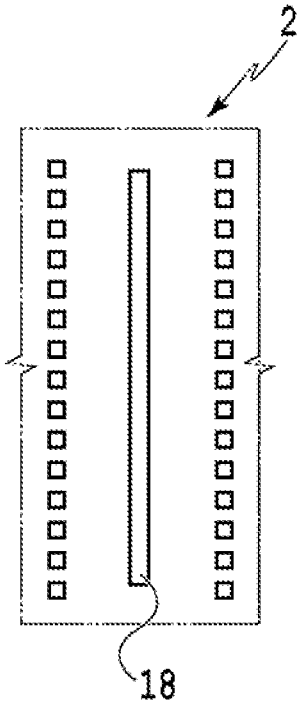
FIG. 4A is a diagram illustrating the front surface of the print element substrate.
Figure 4B:
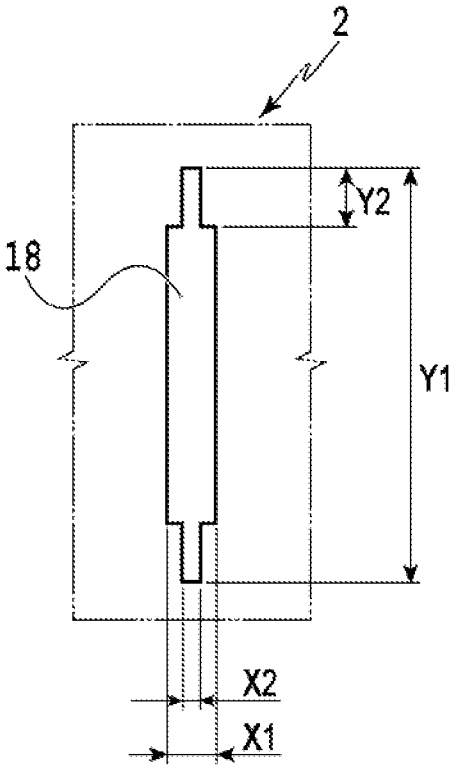
FIG. 4B is a diagram illustrating the back surface of the print element substrate.

FIG. 4A is a diagram illustrating the front surface of the silicon substrate 11 and shows that the opening of the supply port 18 has a uniform opening width across the longitudinal length of the silicon substrate 11 (in the row direction of the ejection port array, here in the up-down direction in the figure). The uniform opening width means that the opening width is the same excluding differences caused by manufacturing variation. Specifically, in the case where a reference opening width is X, opening widths within the range of 95% or more and 105% or less of X are regarded as the uniform opening width relative to the reference opening width. FIG. 4B is a diagram illustrating the back surface of the silicon substrate 11 and shows that the opening of the supply port 18 has a large opening width at the center portion in the longitudinal direction of the silicon substrate 11 and a small opening width at both end portions in the longitudinal direction. As described above, the supply port 18 has different opening shapes on the front surface and back surface of the silicon substrate 11.

Here, the width dimension in the direction intersecting the longitudinal direction of the supply port 18, formed in the silicon substrate 11, at the center portion in the longitudinal direction of the supply port 18 is represented by X1. The width dimension of the openings that are formed in the peripheries of the ends of the ejection port array and are narrower than the center portion in the longitudinal direction of the supply port 18 is represented by X2. Here, the relationship between X1 and X2 that satisfies $X2 \leq X1 \times 1/2$ prevents cracks at the corner portions of the opening ends without decreasing ejection accuracy.

In addition, the dimension in the longitudinal direction of the supply port 18 formed in the silicon substrate 11 is represented by Y1. The dimension in the longitudinal direction of the openings that are formed in the peripheries of the ends of the ejection port array and are narrower than the center portion in the longitudinal direction of the supply port 18 is represented by Y2. Here, the relationship between Y1 and Y2 that satisfies $Y2 \leq Y1 \times 1/10$ prevents cracks at the corner portions of the opening ends without decreasing ejection accuracy. For example, the dimension of Y2 should preferably be 0.5 mm or less.

Figure 5:
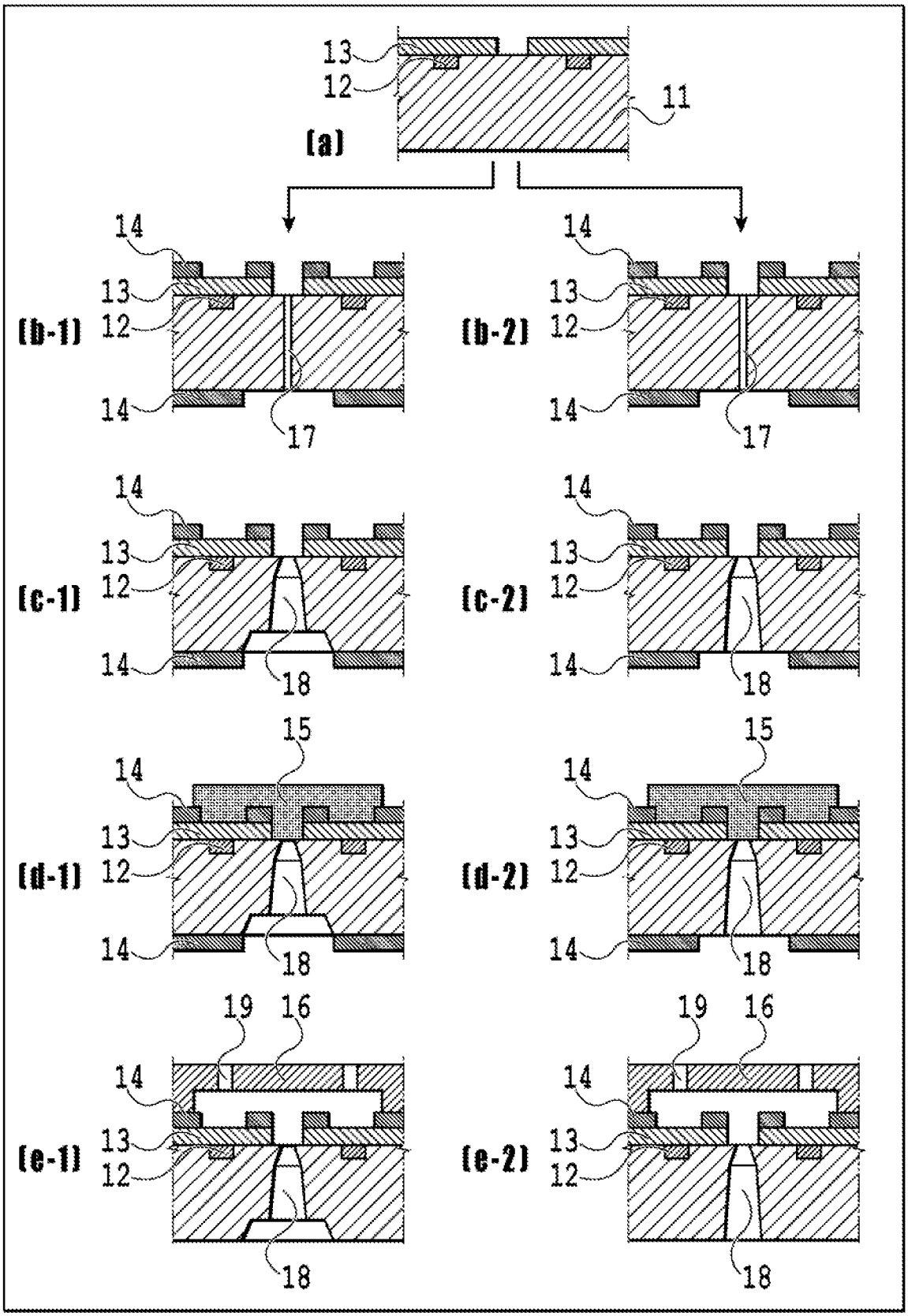
FIG. 5 is a diagram illustrating the manufacturing process of the print element substrate.

FIG. 5 is a diagram illustrating the manufacturing process of the print element substrate 2. Hereinafter, a method of manufacturing the print element substrate 2 will be described in the process order. First, as illustrated in part (a) of FIG. 5, a silicon substrate 11 is prepared in which the principal plane of the base material is [100], a membrane film 13 is formed in advance on the front surface which is the surface having energy generating elements 12, and unnecessary parts of the membrane film 13 are removed by patterning. Note that the material of the membrane film 13 in not limited to any specific one as long as patterning can be performed on the material.

Parts (b-1) to (e-1) of FIG. 5 are cross-sectional views of the position corresponding to V(b-1)(e-1)-V(b-1)(e-1) in FIG. 2; parts (b-2) to (e-2) of FIG. 5 are cross-sectional views of the position corresponding to V(b-2)(e-2)-V(b-2)(e-2) in FIG. 2. Next, resin is applied to the front surface of the silicon substrate 11 illustrated in part (a) of FIG. 5 by spin coating, direct coating, spraying, or other methods, and a protective layer 14 having a desired pattern is formed and serves as a contact layer on the front surface. Note that as a patterning method, the pattern may be formed by applying a resist, then forming a resist pattern by exposure and development, and etching the protective layer 14 using the resist as a mask, or alternatively, direct patterning may be performed using photosensitive material.

On the back surface of the silicon substrate 11, the protective layer 14 is patterned to form an etching pattern for the opening width which is narrower in the peripheries of the ends of the ejection port array than at the center portion. As a method of forming the etching pattern, an etching pattern of an opening having different widths may be formed directly on the back surface by laser light irradiation or drilling instead of using the protective layer 14. Next, a leading hole 17 is formed in the silicon substrate 11. As a method of forming the leading hole 17, laser light irradiation, drilling, or other methods can be used. The process may be performed from the front surface of the silicon substrate 11, or from the back surface. The leading hole 17 may be a through-hole or a non-through-hole. To prevent damage to the membrane film 13 and the protective layer 14 on the front surface, the process of forming the leading hole 17 may be performed after the front surface is protected by cyclized rubber, tape, or the like.

After that, as illustrated in part (c-1) and part (c-2) of FIG. 5, the silicon substrate 11 is etched to form a through-hole having an opening that is narrower in the peripheries of the ends of the ejection port array than at the center portion in the silicon substrate 11. Etching of the silicon substrate 11 may be wet etching using a liquid having a desired alkalinity or may be dry etching using a gas having a desired ratio. Note that the etching process may be performed with the front surface of the silicon substrate 11 protected with cyclized rubber, tape, or the like.

Next, as illustrated in part (d-1) and part (d-2) of FIG. 5, a resin layer 15 composed of photosensitive resin is formed. As a method for this process, the photosensitive resin may be applied by spin coating, direct coating, spraying, or other methods after a hole filling material is put into the supply port 18, or alternatively, the resin layer 15 may be formed into a film, and then the film may be attached to the silicon substrate 11. After that, a desired flow path pattern is formed in the resin layer 15 by exposure and development.

After that, as illustrated in part (e-1) and part (e-2) of FIG. 5, a coating resin which will form an ejection port member 16 is applied onto the resin layer 15 by spin coating, direct coating, spraying, or other methods. After that, the parts corresponding to ejection ports 19 are removed by exposure and development to form the ejection port member 16 having the ejection ports 19. Next, the protective layer 14 formed on the back surface is removed by dry etching. Further, in the case of using a hole filling material, after removing it, the silicon substrate 11 having the resin layer 15 and the ejection port member 16 is immersed in a solvent capable of dissolving the resin layer 15 to remove the resin layer 15 from the silicon substrate 11. With this process, the silicon substrate 11 can be obtained which includes the ejection ports 19, the supply port 18, and the flow paths (supply paths) connecting the ejection ports 19 and the supply port 18. Then, this silicon substrate 11 is cut and divided by a laser sorter, dicing sorter, or the like to obtain print element substrates 2.

Figure 6B:
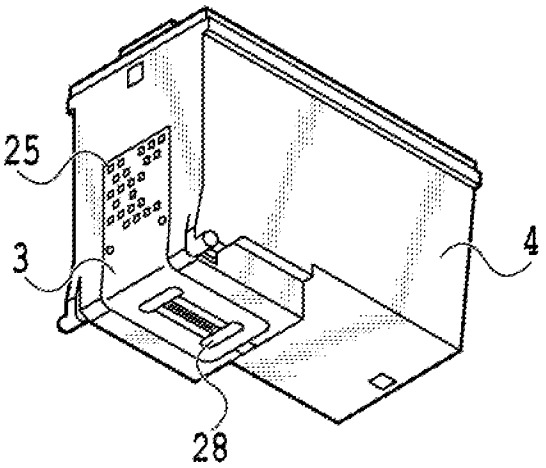
FIG. 6B is a schematic perspective view of the liquid ejecting head.
Figure 6A:
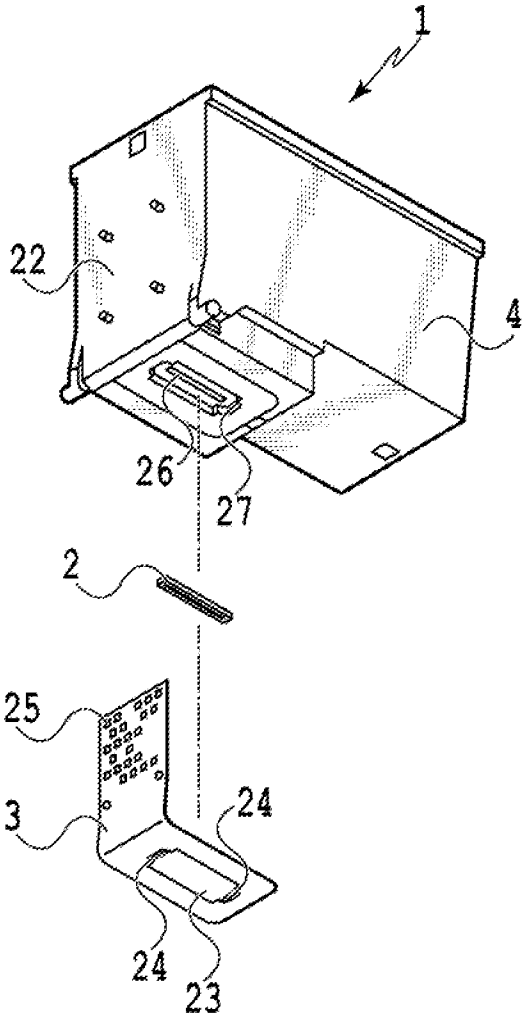
FIG. 6A is a schematic perspective view of the liquid ejecting head.

FIGS. 6A and 6B are schematic perspective views of the liquid ejecting head 1 of the present embodiment. FIG. 6A is an exploded perspective view of the liquid ejecting head 1; FIG. 6B is a perspective view of the liquid ejecting head 1. The support member 4 has a recess, in which a flow path 26 associated with the supply port of the print element substrate 2 is provided. The electric wiring board 3 is provided for the purpose of applying electrical signals to the print element substrate 2 and is provided on the surface of the support member 4 on which the recess is formed. The electric wiring board 3 has a device hole 23 in which the print element substrate 2 is placed, and at two sides of the device hole 23, the lead terminals 24 are formed which are associated with the connection terminals 20 of the print element substrate 2. The lead terminals 24, together with the connection terminals 20 formed along two sides of the ejection port surface 101, form electrical connections (not illustrated). The electric wiring board 3 has external-signal input terminals 25 for receiving drive signals and drive power from the inkjet printing apparatus.

As a forming method, the support member 4 may be formed of resin material or alumina material or may be formed by sintering powder material. Note that in the case of molding resin material, a resin material containing fillers composed of glass or other material may be used to improve the rigidity of the shape. The material composing the support member 4 may be a resin material such as modified PPE (polyphenylene ether), a ceramic material typified by $Al_2O_3$, or any other wide range of materials. This support member 4 has a printing-liquid supply path for supplying printing liquid. In the case of using two or more kinds of printing liquid, partition walls should preferably be formed to prevent each kind of printing liquid from being mixed with another.

Next, an adhesive 27 is applied to the recess of the support member 4 along the periphery of the opening of the flow path 26, and the print element substrate 2 is bonded to the support member 4. As an application method, the adhesive 27 may be transferred with a transfer pin, or it may be applied by drawing with a dispenser. With this process, the flow path 26 of the support member 4 and the supply port 18 of the print element substrate 2 are connected. When the print element substrate 2 is bonded to the support member 4, the adhesive 27 should preferably be pressed with the back surface 102 of the print element substrate 2 after the application of the adhesive 27. After that, the electric wiring board 3 is bonded to a main surface of the support member 4 with an adhesive (not illustrated). The adhesive used for these bonding processes should preferably be one having a favorable ink resistance property, and thus, for example, a thermosetting adhesive containing epoxy resin as the main component can be used for it.

Next, the space between the side surfaces 21*a* of the print element substrate 2 and walls of the recess is sealed with a sealing material 28. After that, the electrical connections are sealed with the sealing material 28. Next, the electrical connections (the upper portions of the lead terminals 24) between the connection terminals 20 of the print element substrate 2 and the lead terminals 24 of the electric wiring board 3 are sealed, and the sealing material 28 is heated and cured.

As described above, in the supply port 18 of the print element substrate 2, the openings, the opening width of which is narrower than the opening width of the center portion in the longitudinal direction, are provided at both end portions in the longitudinal direction. This configuration makes it possible to provide a liquid ejecting head and a method of manufacturing the liquid ejecting head in which a decrease in yield is suppressed.

Second Embodiment

Hereinafter, a second embodiment of the present invention will be described with reference to the drawings. Note that the basic configuration of the present embodiment is the same as that of the first embodiment, and thus, in the following, only characteristic configurations will be described.

Figure 7:
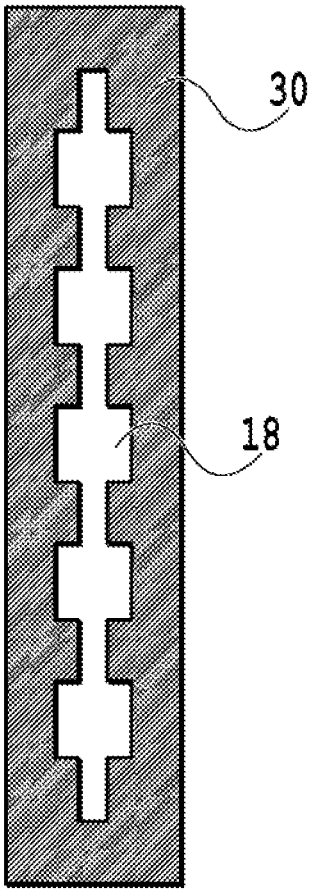
FIG. 7 is a diagram illustrating the back surface of a print element substrate.

FIG. 7 is a diagram illustrating the back surface of a print element substrate 30 of the present embodiment. The opening of the supply port 18 on the back surface of the print element substrate 30 has a shape in which the opening width is narrow at both end portions in the longitudinal direction, between which (at portions other than both end portions) a portion having a wide opening width and a portion having a narrow opening width are alternately arranged. This shape of the opening of the supply port 18 makes it possible to prevent cracks of the print element substrate 2 that would occur at the corner portions of the opening ends without decreasing ejection accuracy. Note that the supply port 18 may have multiple different opening widths in the width direction at portions other than both end portions.

Third Embodiment

Hereinafter, a third embodiment of the present invention will be described with reference to the drawings. Note that the basic configuration of the present embodiment is the same as that of the first embodiment, and thus, in the following, only characteristic configurations will be described.

Figure 8:
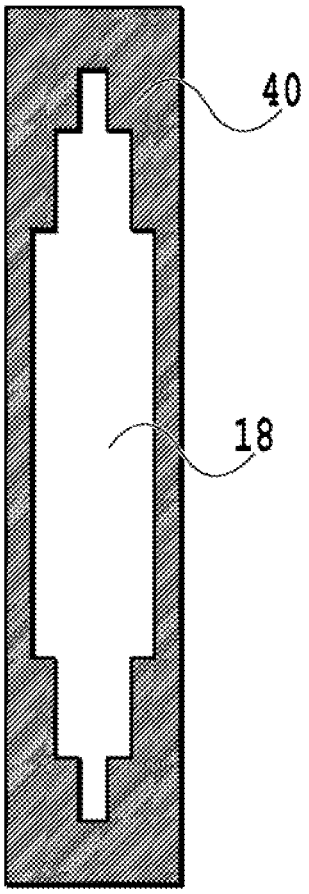
FIG. 8 is a diagram illustrating the back surface of a print element substrate.

FIG. 8 is a diagram illustrating the back surface of a print element substrate 40 of the present embodiment. The opening of the supply port 18 on the back surface of the print element substrate 40 has multiple different opening widths at both end portions in the longitudinal direction, and the opening width at both ends is the most narrow. The present embodiment has two different opening widths at both end portions in the longitudinal direction. To be more specific, the supply port 18 has openings with the most narrow opening width at both ends in the longitudinal direction, openings with the second most narrow opening width adjoining the openings with the most narrow opening width, and further, openings with the widest opening width adjoining the openings with the second most narrow opening width. This shape of the opening of the supply port 18 makes it possible to prevent cracks of the print element substrate 2 that would occur at the corner portions of the opening ends without decreasing ejection accuracy.

Fourth Embodiment

Hereinafter, a fourth embodiment of the present invention will be described with reference to the drawings. Note that the basic configuration of the present embodiment is the same as that of the first embodiment, and thus, in the following, only characteristic configurations will be described.

Figure 9:
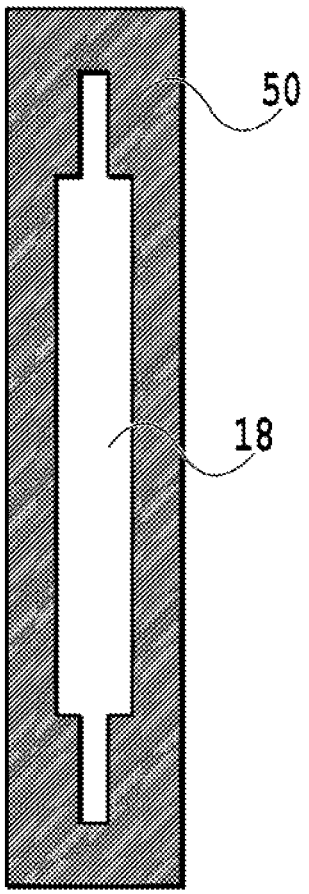
FIG. 9 is a diagram illustrating the back surface of a print element substrate.

FIG. 9 is a diagram illustrating the back surface of a print element substrate 50 of the present embodiment. The opening of the supply port 18 of the print element substrate 50 has the same opening shape on the front surface and the back surface. To be more specific, the opening of the supply port 18 on the front surface also has a shape in which the opening widths are small at both end portions in the longitudinal direction. This shape of the opening of the supply port 18 makes it possible to prevent cracks of the print element substrate 2 that would occur at the corner portions of the opening ends without decreasing ejection accuracy. Note that even if there is a difference between the two opening shapes, if the difference is only caused by manufacturing variation, these opening shapes are regarded as the same opening shape.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-168178 filed Sep. 7, 2018, which is hereby incorporated by reference herein in its entirety.

What is claimed is:

1. A liquid ejecting head comprising;

a substrate including an ejection port array in which multiple ejection ports, each capable of ejecting liquid, are arrayed, and a supply port which communicates with the ejection ports and opens to a back surface of the substrate opposed to a front surface of the substrate on which the ejection ports are located, wherein the supply port is arranged along the ejection port array, the opening width, in a width direction intersecting a row direction of the ejection port array, of at least one end portion in the row direction of the supply port is narrower than the opening width in the width direction of a center portion in the row direction of the supply port, the substrate is formed by joining a first member in which the ejection ports are formed and a second member in which the supply port is formed, and the supply port has different opening shapes on a joint surface of the second member to which the first member is joined and on a surface of the second member opposed to the joint surface.

2. The liquid ejecting head according to claim 1, wherein $X2 \leq X1 \times 1/2$ holds, where X1 represents the opening width in the width direction of the center portion of the supply port, and X2 represents the opening width in the width direction of the end portion of the supply port.

3. The liquid ejecting head according to claim 1, wherein $Y2 \leq Y1 \times 1/10$ holds, where Y1 represents the length in the row direction of the supply port, and Y2 represents the length in the row direction of a portion of the end portion in which the opening width in the width direction is narrow.

4. The liquid ejecting head according to claim 1, wherein the supply port on the joint surface has a uniform opening width across the length in the row direction of the supply port.

5. The liquid ejecting head according to claim 4, wherein the supply port on the joint surface has an opening width narrower than the opening width of the at least one end portion in the row direction of the supply port on the surface opposed to the joint surface.

6. The liquid ejecting head according to claim 1, wherein the substrate is adhesively attached to a support member that supports the substrate.

7. The liquid ejecting head according to claim 6, wherein the support member is formed of resin.

8. The liquid ejecting head according to claim 1, wherein the second member is formed of silicon.

9. The liquid ejecting head according to claim 1, wherein the center portion of the supply port on the surface opposed to the joint surface has multiple different opening widths in the width direction.

10. The liquid ejecting head according to claim 9, wherein the supply port on the surface opposed to the joint surface has an opening having a first opening width at each end portion in the row direction of the supply port, and at the center portion of the supply port on the surface opposed to the joint surface, openings having a second opening width which is wider than the first opening width and openings having the first opening width are arranged alternately.

11. The liquid ejecting head according to claim 9, wherein the supply port on the surface opposed to the joint surface has an opening having a first opening width at each end portion in the row direction of the supply port, an opening having a second opening width wider than the first opening width at each end portion in the row direction of the center portion, and an opening having a third opening width wider than the second opening width at the center portion excluding each end portion of the center portion.

12. A method of manufacturing a liquid ejecting head comprising a substrate including an ejection port array in which multiple ejection ports, each capable of ejecting liquid are arrayed, and a supply port which communicates with the ejection ports and opens to a back surface of the substrate opposed to a front surface of the substrate on which the ejection ports are located, comprising:

forming the supply port, the supply port being arranged along the ejection port array, the opening width, in a width direction intersecting a row direction of the ejection port array, of at least one end portion in the row direction of the supply port being narrower than the opening width in the width direction of a center portion in the row direction of the supply port, wherein the substrate is formed by joining a first member in which the ejection ports are formed and a second member in which the supply port is formed, and the supply port has different opening shapes on a joint surface of the second member to which the first member is joined and on a surface of the second member opposed to the joint surface.

* * * * *